US008430603B2

(12) United States Patent
Price

(10) Patent No.: US 8,430,603 B2
(45) Date of Patent: Apr. 30, 2013

(54) WALL BLOCK WITH BARRIER MEMBER

(75) Inventor: Brian A Price, Rochester, MN (US)

(73) Assignee: Mortarless Technologies, LLC, Rochester, MN (US)

( * ) Notice: Subject to any disclaimer, the term of this patent is extended or adjusted under 35 U.S.C. 154(b) by 325 days.

(21) Appl. No.: 12/772,364

(22) Filed: May 3, 2010

(65) Prior Publication Data

US 2010/0284751 A1 Nov. 11, 2010

Related U.S. Application Data

(60) Provisional application No. 61/175,716, filed on May 5, 2009.

(51) Int. Cl.
*E02D 29/02* (2006.01)

(52) U.S. Cl.
USPC ..... 405/262; 405/286

(58) Field of Classification Search ..... 405/262, 405/284, 285, 286, 287
See application file for complete search history.

(56) References Cited

U.S. PATENT DOCUMENTS

| | | | | |
|---|---|---|---|---|
| 4,824,293 | A * | 4/1989 | Brown et al. | 405/284 |
| 4,914,887 | A * | 4/1990 | Meheen | 405/284 |
| 5,017,049 | A * | 5/1991 | Sievert | 405/284 |
| 5,294,216 | A * | 3/1994 | Sievert | 405/286 |
| 5,653,558 | A * | 8/1997 | Price | 405/284 |
| 5,934,838 | A * | 8/1999 | Egan | 405/262 |
| 6,443,663 | B1 * | 9/2002 | Scales et al. | 405/262 |
| 6,468,004 | B1 * | 10/2002 | Price | 405/262 |
| 6,571,529 | B2 | 6/2003 | Knudson et al. | |
| 6,695,544 | B2 | 2/2004 | Knudson et al. | |
| 6,817,154 | B2 | 11/2004 | Dolan et al. | |
| 7,198,435 | B2 | 4/2007 | Dolan et al. | |
| 7,396,190 | B2 * | 7/2008 | Price | 405/284 |
| 7,731,455 | B2 * | 6/2010 | Shin | 405/262 |
| 7,854,573 | B2 | 12/2010 | Knudson et al. | |
| 7,866,932 | B1 | 1/2011 | Pool | |
| 7,987,646 | B2 | 8/2011 | Race et al. | |
| 2003/0210960 | A1 * | 11/2003 | Woolford et al. | 405/262 |
| 2005/0102950 | A1 | 5/2005 | Knudson et al. | |
| 2005/0129468 | A1 | 6/2005 | Knudson et al. | |
| 2005/0241257 | A1 | 11/2005 | Price | |
| 2005/0254906 | A1 | 11/2005 | Dolan et al. | |
| 2006/0110222 | A1 * | 5/2006 | Price | 405/286 |

(Continued)

*Primary Examiner* — Frederick L Lagman
(74) *Attorney, Agent, or Firm* — Fish & Richardson P.C.

(57) ABSTRACT

A retaining wall block can include a top surface and opposing bottom surface, a front surface and opposing rear surface, and first and second opposing side surfaces. A projection can extend downwardly from the bottom surface and can include a forwardly facing indexing surface oriented generally parallel with the front surface of the block. The indexing surface can be configured to engage a rearwardly facing surface of a block in a lower course of blocks. The block can also include a pair of spaced apart key slots defined in the rear surface. Each key slot can include an enlarged interlocking portion and a throat portion extending from the interlocking portion to the rear surface. An assembly can be created whereby a pair of correspondingly shaped keys of an elongate barrier member are engaged with key slots of block so as to inhibit rearward horizontal displacement of the keys within the key slots. Elongate barrier member can include a body presenting an inner surface and an outer surface and a pair of opposing ends, each opposing end defined one of the keys. The inner surface of the barrier member and the rear surface of the block can together define a core region for receiving fill material.

23 Claims, 12 Drawing Sheets

U.S. PATENT DOCUMENTS

2006/0153647 A1* 7/2006 Woolford et al. ..... 405/286
2007/0003380 A1 1/2007 Knudson et al.
2007/0003381 A1* 1/2007 Lee ..... 405/286
2007/0036616 A1 2/2007 Knudson et al.
2008/0289283 A1* 11/2008 Shin ..... 52/604
2008/0298902 A1 12/2008 Knudson et al.
2008/0310926 A1 12/2008 Knudson et al.
2009/0068406 A1 3/2009 Race et al.
2011/0146175 A1 6/2011 Forsberg et al.
2011/0150579 A1 6/2011 Knudson et al.
2011/0182674 A1 7/2011 Knudson et al.

* cited by examiner

WALL BLOCK WITH BARRIER MEMBER

CROSS-REFERENCE TO RELATED APPLICATION

This application claims priority to U.S. patent application Ser. No. 61/175,716, filed on May 5, 2009, the entire contents of which are hereby incorporated by reference.

TECHNICAL FIELD

This document relates generally to retaining walls. More particularly, this document relates to manufactured blocks that are used to construct mortarless retaining walls.

BACKGROUND INFORMATION

Concrete blocks for free standing and retaining walls have been known and used for many years. They can be both functional and decorative, and range from small gardening applications to large-scale construction projects. Such walls are typically used to form horizontal surfaces or terraces by providing a generally vertically extending barrier behind which backfill may be deposited. Such walls reduce erosion and slumping, maximize land use, and can provide an attractive and decorative appearance.

Retaining walls can be constructed from stackable concrete blocks. Blocks are stacked in horizontal rows called courses. Multiple successive courses may be used to create a vertically rising wall of a desired height. Often, there will be a slight setback between adjacent courses so that the wall gradually slopes backwards as it gets taller, which helps the wall resist loads from the earth retained behind it. These types of blocks can generally be assembled quickly and economically due to the interlocking of adjacent courses of blocks. A type of retaining wall that can be built using blocks known as mechanically stabilized earth retaining walls employs either metallic or polymeric tensile reinforcements, often referred to as grids, in the earth mass behind the wall. The grids extend horizontally from between adjacent courses of blocks back into the soil, which creates a stronger wall more resistant to tipping.

Concrete wall blocks are typically manufactured using the conventional dry cast manufacturing process. In such process, a zero slump concrete mixture is introduced into a mold apparatus. Then a head compresses the mixture in the mold to form a slug that is subsequently cured and often split into two wall blocks.

Retaining walls for large-scale applications can require rather large blocks. Blocks weighing between 60 and 100 pounds or larger are commonly used. Such blocks increase the strength of the wall due to their weight and depth. These characteristics give them enhanced ability to hold grids in place. However, large blocks make building a wall a much more arduous task due to their size and weight. This tends to increase the labor costs associated with building a wall out of such blocks.

Larger blocks are also more expensive to make and ship. Fewer blocks can be made at one time in a mold, so production is slower and more concrete mix must be used. Also, due to weight and height restrictions on the trucks that transport the blocks, fewer larger blocks can be shipped at a time so transportation costs are increased.

SUMMARY

A retaining wall block can include a top surface and opposing bottom surface, a front surface and opposing rear surface, and first and second opposing side surfaces. A projection can extend downwardly from the bottom surface and can include a forwardly facing indexing surface oriented generally parallel with the front surface of the block. The indexing surface can be configured to engage a rearwardly facing surface of a block in a lower course of blocks. The block can also include a pair of spaced apart key slots defined in the rear surface. Each key slot can include an enlarged interlocking portion and a throat portion extending from the interlocking portion to the rear surface. An assembly can be created whereby a pair of correspondingly shaped keys of an elongate barrier member are engaged with key slots of block so as to inhibit rearward horizontal displacement of the keys within the key slots. Elongate barrier member can include a body presenting an inner surface and an outer surface and a pair of opposing ends, each opposing end defined one of the keys. The inner surface of the barrier member and the rear surface of the block can together define a core region for receiving fill material.

DETAILED DESCRIPTION

Figure 1D:
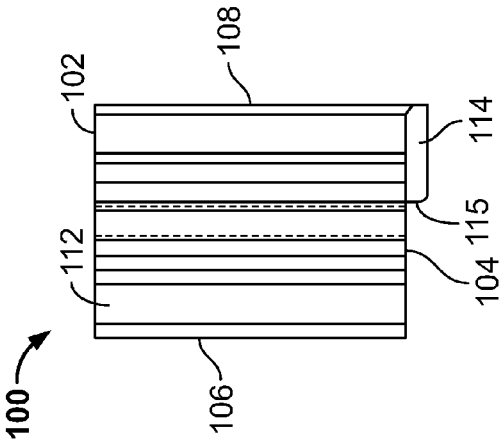
FIG. 1D is a side view of a wall block according to one example embodiment.
Figure 1A:
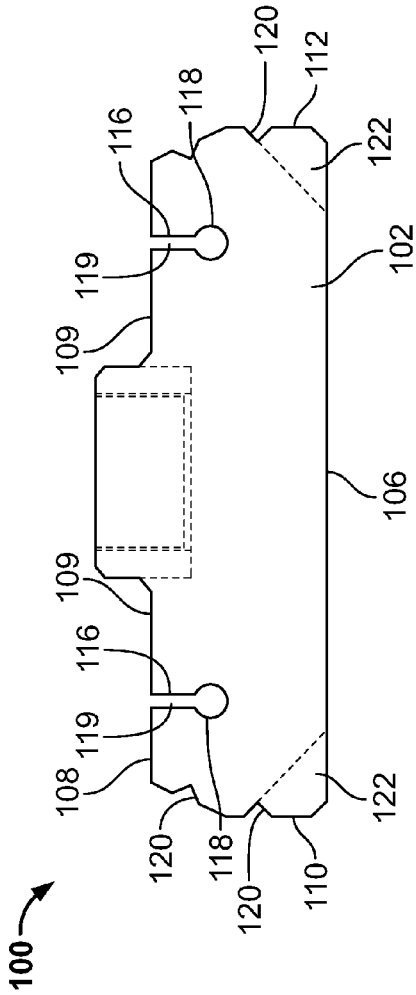
FIG. 1A is a top view of a wall block according to one example embodiment.
Figure 1C:
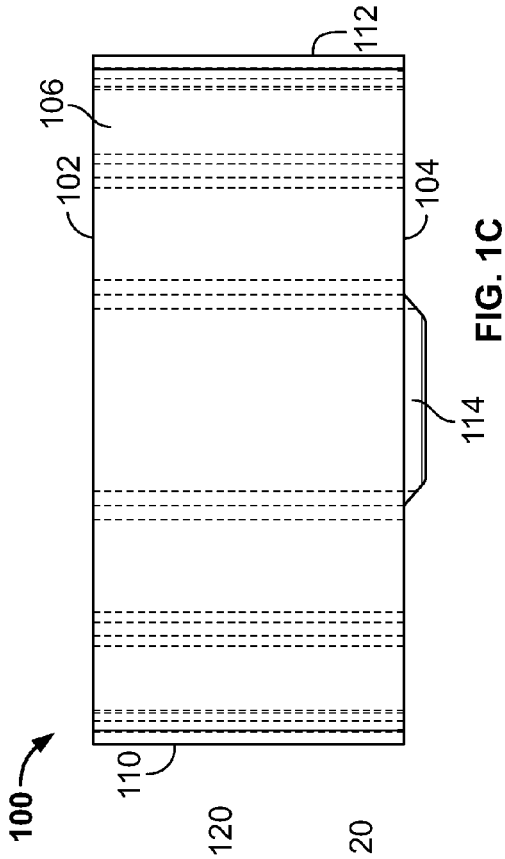
FIG. 1C is a front view of a wall block according to one example embodiment.
Figure 1B:
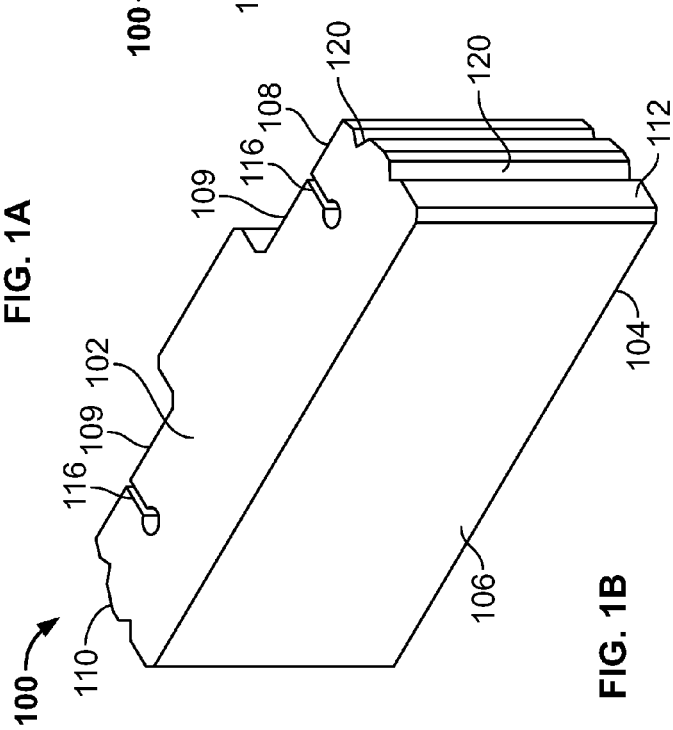
FIG. 1B is a perspective view of a wall block according to one example embodiment.
Figure 2D:
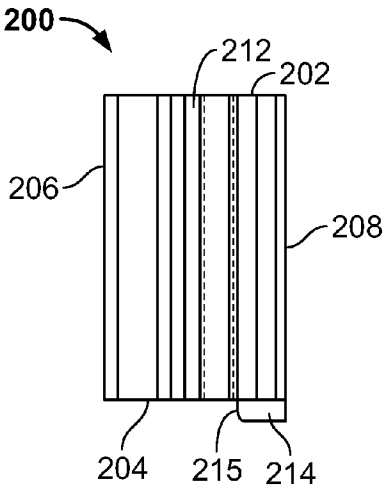
FIG. 2D is a side view of a wall block according to one example embodiment.
Figure 2A:
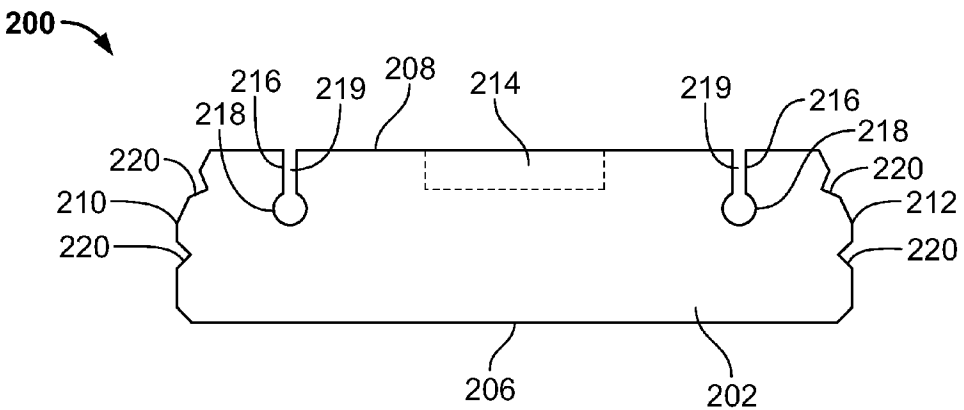
FIG. 2A is a top view of a wall block according to one example embodiment.
Figure 2C:
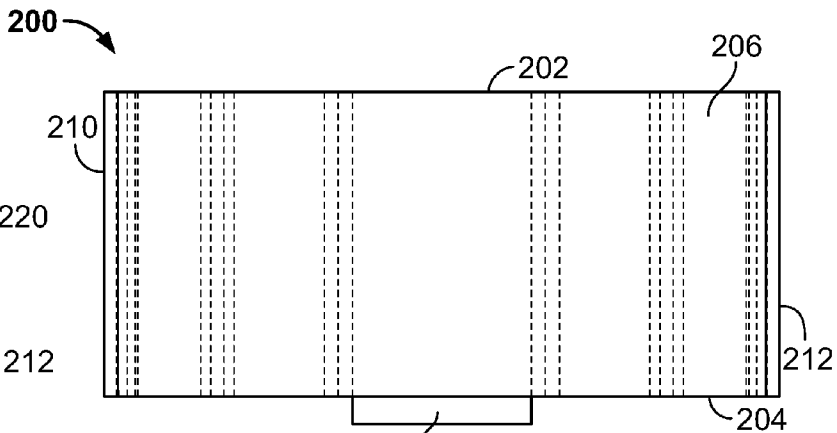
FIG. 2C is a front view of a wall block according to one example embodiment.
Figure 2B:
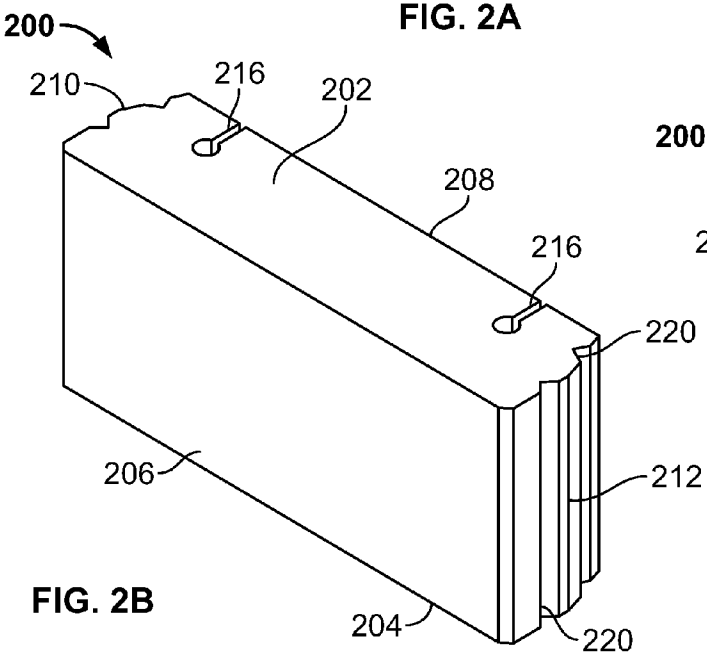
FIG. 2B is a perspective view of a wall block according to one example embodiment.
Figure 3B:
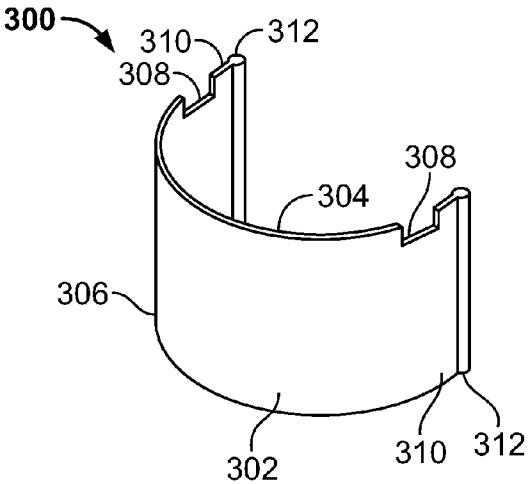
FIG. 3B is a perspective view of a barrier member according to one example embodiment.
Figure 3D:
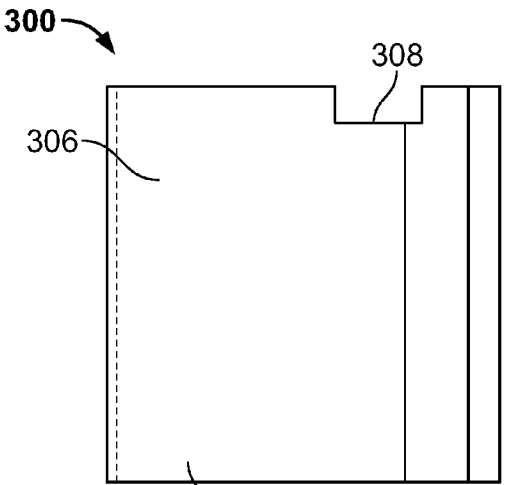
FIG. 3D is a side view of a barrier member according to one example embodiment.
Figure 3A:
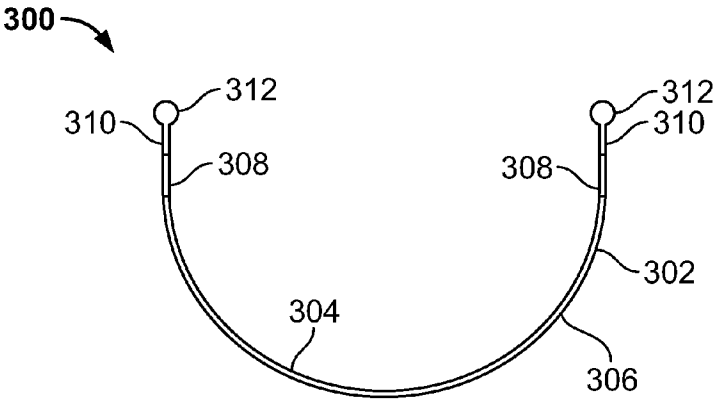
FIG. 3A is a top view of a barrier member according to one example embodiment.
Figure 3C:
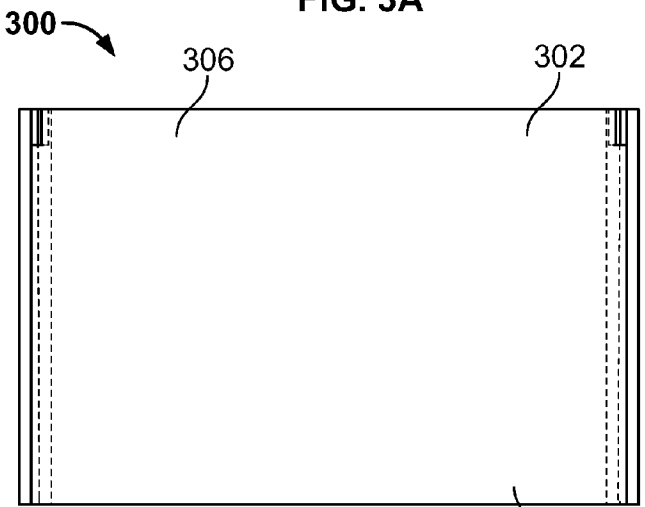
FIG. 3C is a front view of a barrier member according to one example embodiment.
Figure 4A:
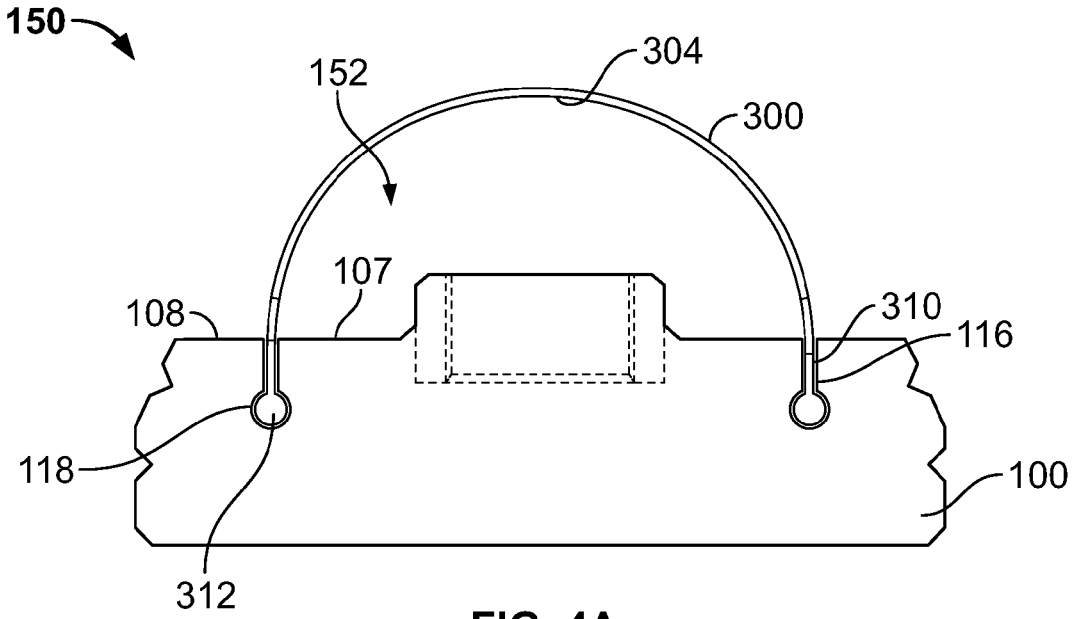
FIG. 4A is a top view of a block assembly according to one example embodiment.
Figure 4B:
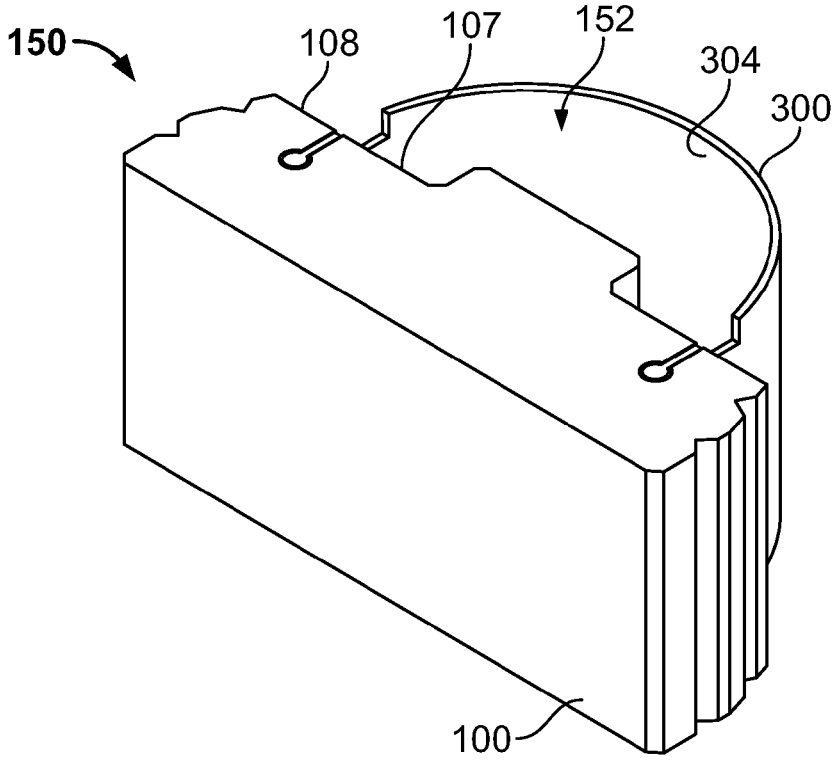
FIG. 4B is a perspective view of a block assembly according to one example embodiment.
Figure 4C:
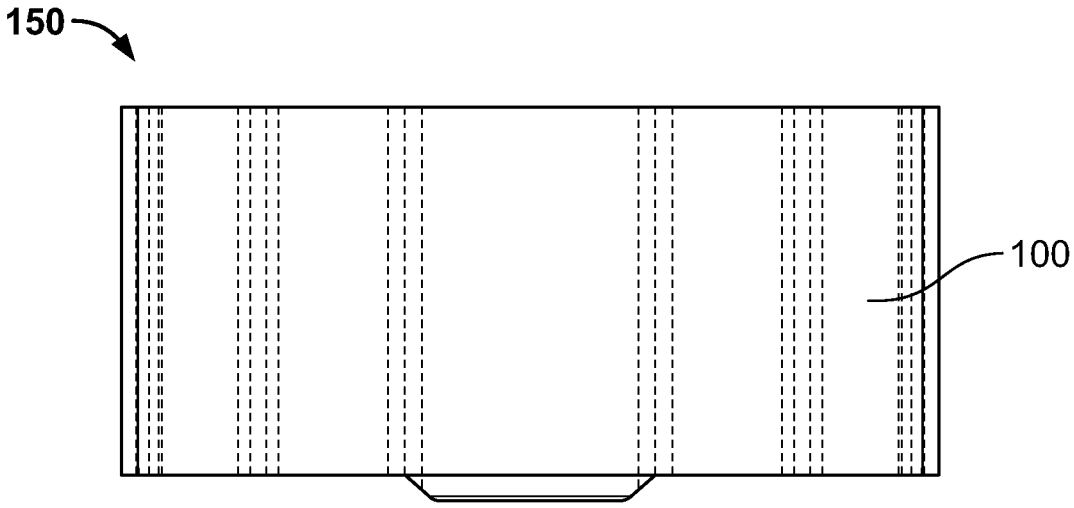
FIG. 4C is a front view of a block assembly according to one example embodiment.
Figure 4D:
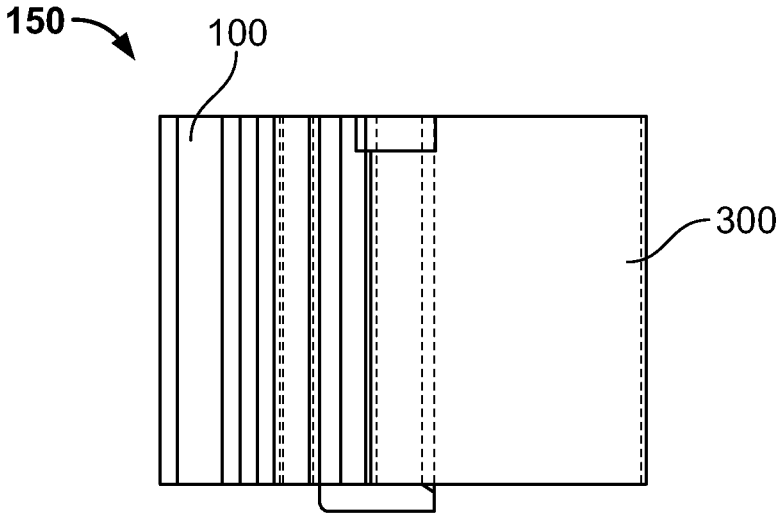
FIG. 4D is a side view of a block assembly according to one example embodiment.

The use of wall blocks with attached barrier members enables wall systems to be constructed with decreased cost and labor. Walls having the same or more strength and stability as walls built with large retaining wall blocks can be built with much smaller wall blocks used with barrier members because blocks and barrier members function as a single unit and the banded region created by attaching barrier members to wall blocks provides a large amount of space that can be backfilled with crushed rock, dirt, or the like. Construction of such walls is much less labor intensive because of the reduced block size and weight and because barrier members are easily engaged with blocks. Substantial cost savings results because less concrete mixture is needed to form each block. Moreover, labor costs of building a wall with such blocks are reduced, more blocks can be shipped on a truck of the same size, and more blocks can be produced in the same size mold.

Referring to FIGS. 1A-1D, there is depicted a wall block 100 according to one example embodiment. Wall block 100 generally includes a top surface 102 and opposing bottom surface 104, a front surface 106 and opposing rear surface 108, and first 110 and second 112 opposing side surfaces. Rear surface 108 defines a pair of rearwardly facing shoulders 109 that can be generally parallel with front surface 106. A projection 114 can extend downwardly from bottom surface 104. Wall block 100 can also include a pair of spaced apart key slots 116 defined in rear surface 108. Each key slot 116 can include an enlarged interlocking portions 118 and a throat portion 119 extending from the interlocking portion 118 to the rear surface 108. Key slots 116 can extend in a generally vertical direction all the way through the block 100 from the top surface 102 to the bottom surface 104. Alternatively, key slots 116 can extend only partway through the block 100. Side surfaces 110, 112 can define one or more notches 120. Notches 120 can be used to split off portions of the block, such as corner portions 122, to vary the block's appearance.

FIGS. 2A-2D depict another wall block 200 according to an example embodiment. Wall block 200 generally includes a top surface 202 and opposing bottom surface 204, a front surface 206 and opposing rear surface 208, and first 210 and second 212 opposing side surfaces. In contrast to multi-planar rear surface 108 of wall block 100, rear surface 208 of wall block 200 presents a single rearwardly facing surface 209 that can be generally parallel to front surface 206. A projection 214 extends downwardly from bottom surface 204 that is substantially wider than it is deep. Wall block 200 can also include key slots 216 having enlarged interlocking portions 218 and throat portions 219. Side surfaces 210, 212 can be provided with one or more notches 220.

Projections 114, 214 of wall blocks 100, 200 can be used to interlock vertically adjacent blocks in a wall structure. Each projection 114, 214 includes a forwardly facing indexing surface 115, 215 that can be oriented generally parallel with front surface 106, 206. Indexing surfaces 115, 215 can abut rearwardly facing surfaces 109, 209 of blocks in the course below to interlock blocks together. Rearwardly facing surfaces 109, 209 can be oriented relative to front surface 106, 206 in various ways, such as, for example, generally parallel or substantially parallel. Interlock, as it is used in the present document, is used as it is commonly used in the retaining wall block art, which is to prevent blocks from moving forward relative to each other when stacked in a wall. Projections 114, 214 can also serve to provide a setback between adjacent courses of blocks. Projections of other types and shapes than projections 114, 214 can be used, such as blocks having a greater depth than width or having the same depth and width. In addition, interlocking can be accomplished by clips or by providing the blocks with pinholes and using pins.

Front surfaces 106, 206 of blocks 100, 200 may be given a decorative appearance. Such decorative appearances can include broken rock, stacked rocks, natural stone, brick, striated or roughened texture. Persons of skill in the art will recognize that the blocks provided herein are not limited to a specific decorative facial appearance unless specifically indicated in a given Claim. Alternatively, some or all of the front surface may be provided with a smooth appearance. Blocks can also be provided with an asymmetric front surface having a vertical notch running through the front surface that divides it into two unequally sized faces as disclosed in U.S. Patent Publication No. 20050241257A1, which is herein incorporated by reference in its entirety.

Figure 11:
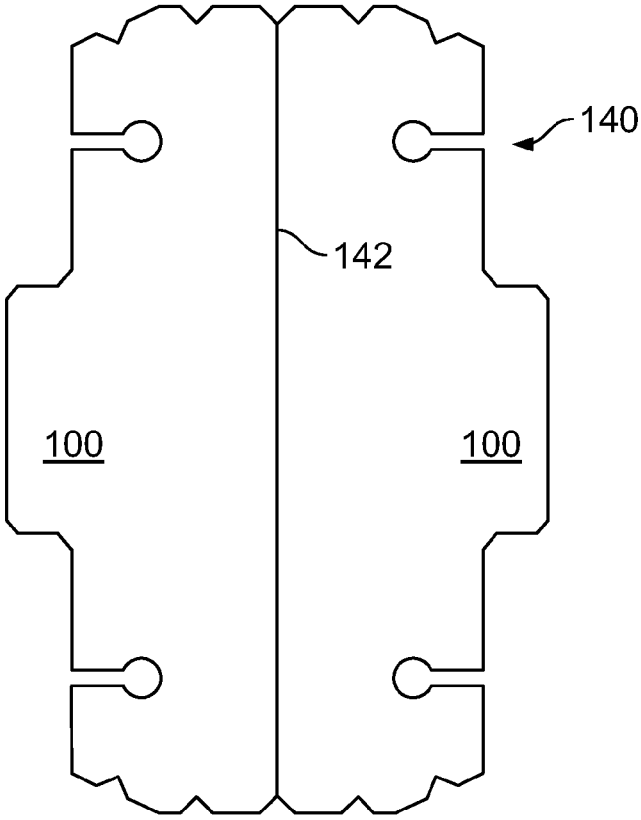
FIG. 11 is a top view of a slug according to one example embodiment.
Figure 12A:
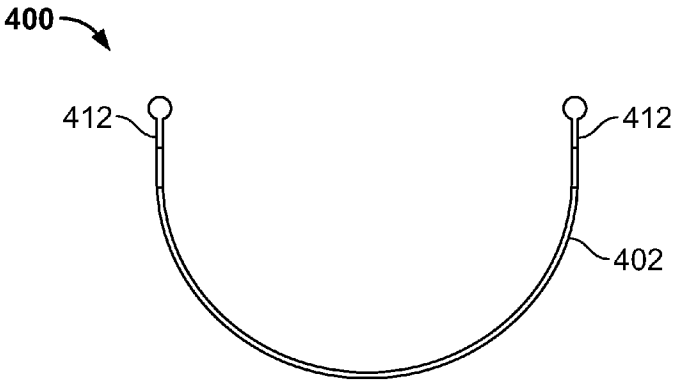
FIG. 12A is a top view of a barrier member according to one example embodiment.
Figure 12B:
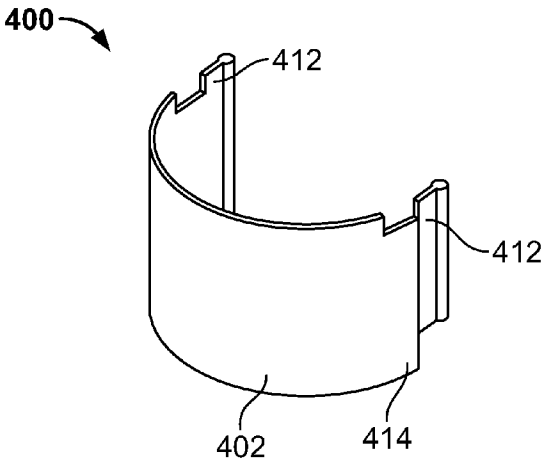
FIG. 12B is a perspective view of a barrier member according to one example embodiment.
Figure 12C:
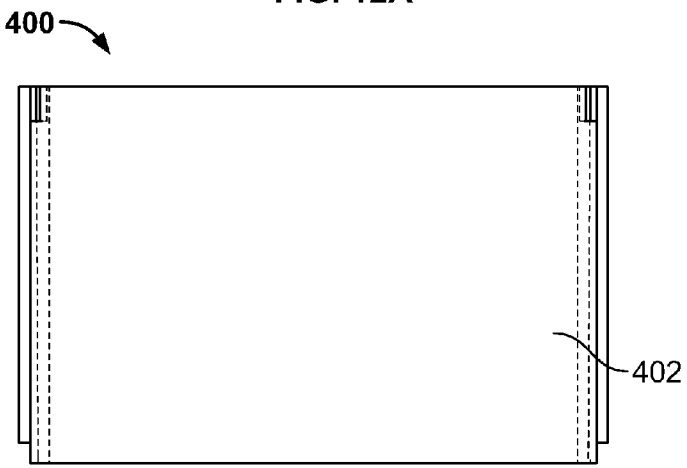
FIG. 12C is a front view of a barrier member according to one example embodiment.
Figure 12D:
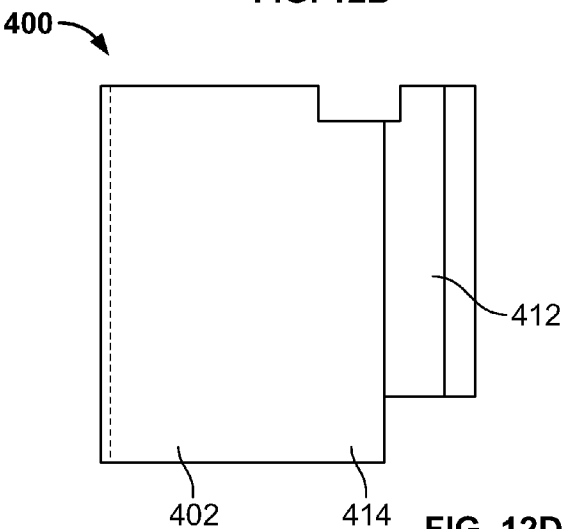
FIG. 12D is a side view of a barrier member according to one example embodiment.

Blocks provided herein are preferably made from a rugged, weather resistant material, such as zero-slump concrete, for high strength and durability in outdoor applications. However, blocks may be made of numerous other materials, for example, plastic, fiberglass, wood, metal, or stone. Blocks can be manufactured in a high-speed application using the so called dry-cast manufacturing method known in the art. The material composition for such a process is generally sand, aggregate, cement, fly ash and, optionally, selected admixtures. Persons having skill in the art of dry-cast concrete block manufacture understand that material mixtures can be varied to meet a variety of performance requirements. Blocks can be manufactured in a twinned slug 140 as shown in FIG. 11. Slugs 140 can be split along a splitting plane 142 to form a pair of wall blocks 100.

Referring to FIGS. 3A-3D, there can be seen an elongate barrier member 300 according to one example embodiment. Barrier member 300 includes a body 302 presenting an inner surface 304 and an outer surface 306. Although body 302 is shown as being arcuate, body 302 can take on a variety of different shapes, such as, for example, square, rectangular, polygonal, and triangular. A barrier member 300 that takes on an arcuate shape when interlocked with a block (described below) can initially take on a different shape, such as a flat, straight piece and then be bent into an arcuate shape. Barrier member 300 can also include a pair of notches 308. The opposing ends of barrier member 300 can each define a key 310 that includes an enlarged interlocking portion 312.

Barrier member 300 can be composed of a flexible material or a rigid material. Suitable materials include, for example, plastic, steel, aluminum or welded wire. One of skill in the art will recognize that numerous other materials may be used in barrier member 300. Although depicted as being comprised of a solid material, barrier member can also be formed from a gridded or woven material, with or without apertures in the matrix.

Referring to FIGS. 12A-12D, there can be seen a barrier member 400 according to another example embodiment. Barrier member 400 includes a body 402 and a pair of keys 412. Lip portion 414 of body 402 extends below keys 412. Lip portion 414 can be used like a projection of a wall block to interlock adjacent blocks and barrier members. Lip portion 414 can abut rearwardly facing surfaces 109, 209 of blocks in the course below to interlock blocks together.

Wall blocks 100, 200 can be used in conjunction with barrier members 300 in a block assembly 150. As can be seen in FIGS. 4A-4D, key slots 116 of wall block 100 are configured to slidably receive correspondingly shaped keys 310 of barrier member 300 therein. Enlarged interlocking portion 312 of each key 310 is received in the enlarged interlocking portion 118 of a separate one of the key slots 116 so as to inhibit rearward horizontal displacement of the keys 310 within the key slots 116. Barrier member 300 can be disengaged from wall block 100 by sliding it vertically out of key slots 116. Therefore, when block assembly 150 is used in a multiple course wall system, barrier member 300 is locked into place by vertically adjacent blocks. Each block 100 and barrier member 300 thus generally function together as a single unit. Although shown as having a circular cross-section, interlocking portions 118, 312 can take on a variety of shapes, such as, for example, triangular, polygonal or diamond shaped.

Figure 5A:
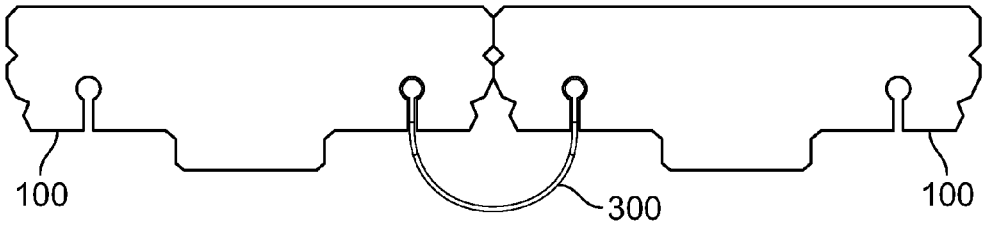
FIGS. 5A-5C are top views of block assemblies according to one example embodiment.
Figure 5B:
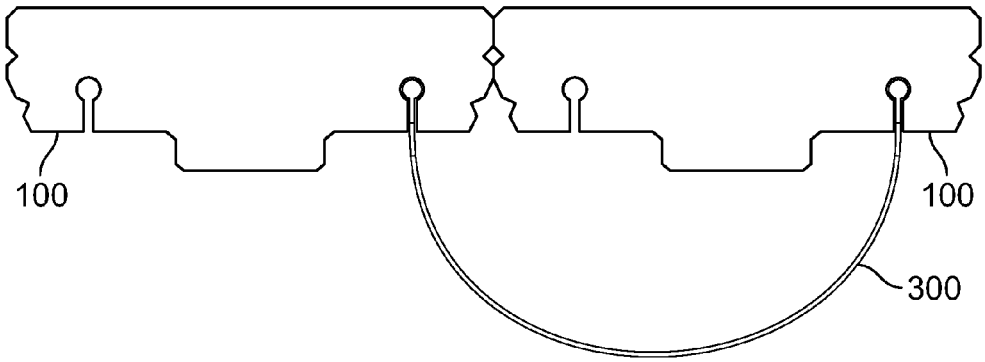
Figure 5C:
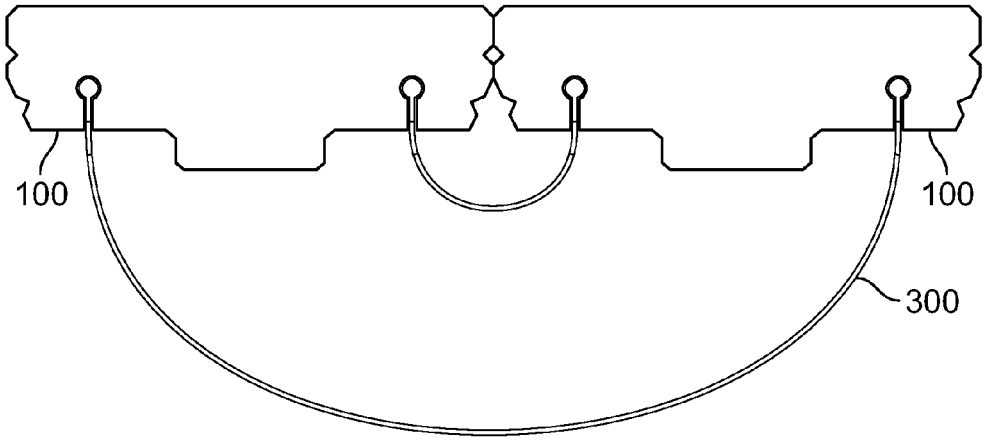
Figure 13:
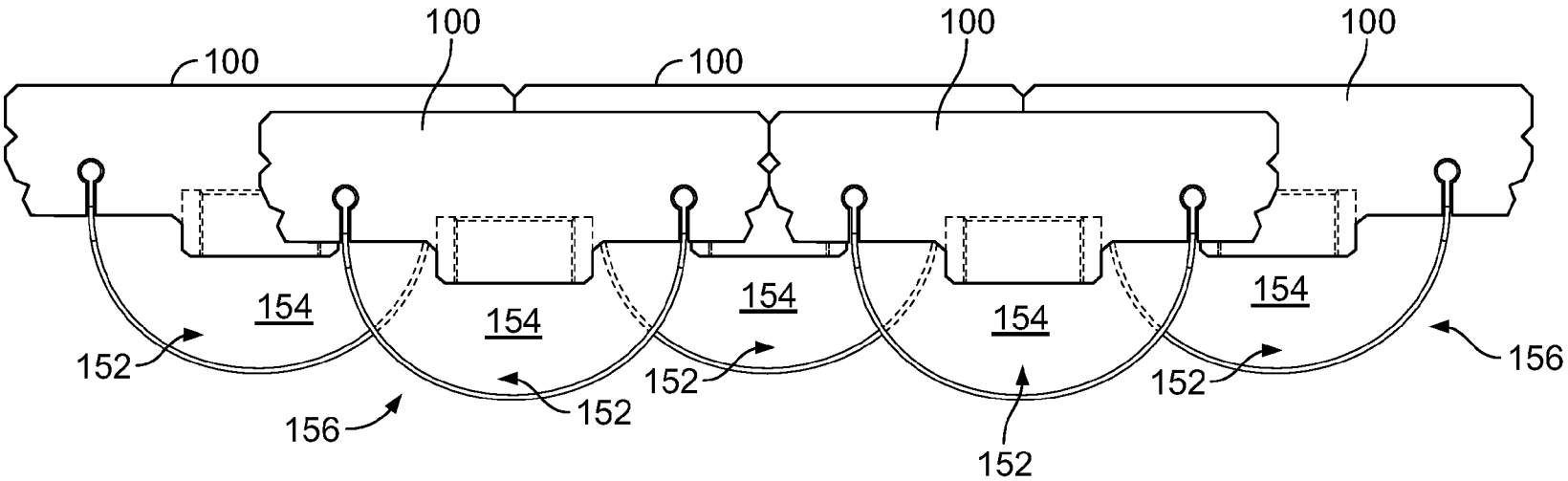
FIG. 13 is a top view of a course of wall blocks according to one example embodiment.

A bounded area or core region 152 is formed by engaging barrier member 300 with wall block 100. Core region 152 is defined by the boundary of the inner surface 304 of barrier member 300 and the portion 107 of rear surface 108 that is enclosed by the barrier member 300. Core region 152 can be filled with crushed rock, dirt, or other fill material known in the art when block assemblies 150 are used to build a wall system. Filling core regions 152 of block assemblies 150 with crushed rock 154 in a vertically rising wall forms a series of stone columns 156, as seen in FIG. 13. Stone columns 156 are advantageous because they create a stronger interlock between blocks, resist shear forces on the wall and promote drainage. Use of blocks 100 with barrier members 300 therefore allows walls to have the strength and other benefits of a larger and deeper block without the increased weight and other disadvantages of such blocks. As shown in FIGS. 5A-5C, rather than engaging a single block, barrier members 300 of various different sizes can be engaged to a pair of horizontally adjacent wall blocks 100, thereby locking the blocks 100 together.

Figure 6:
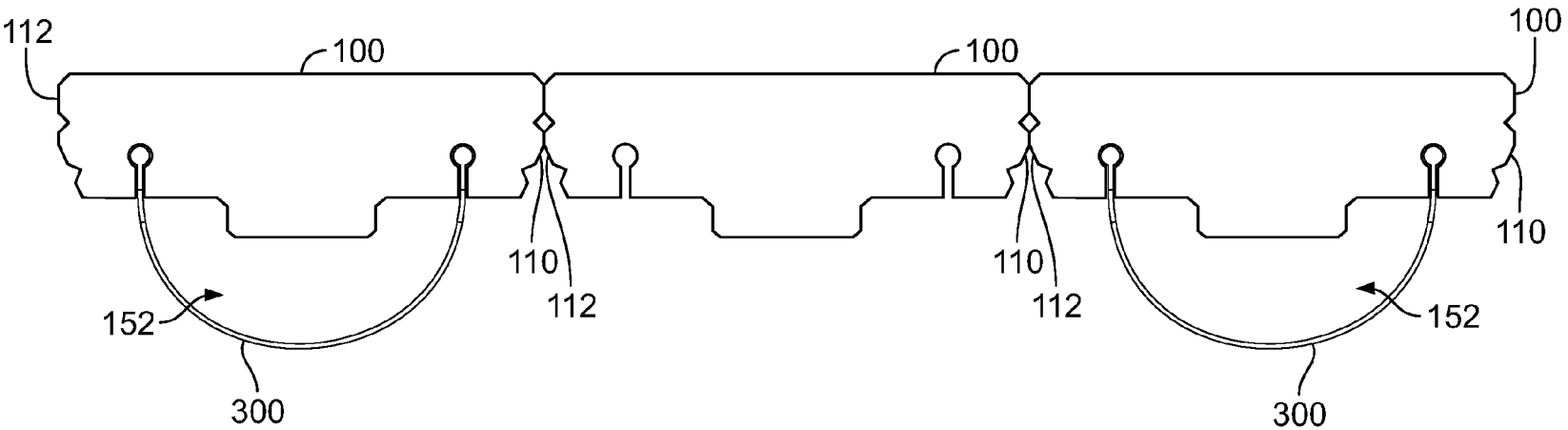
FIG. 6 is a top view of a course of wall blocks according to one example embodiment.

Wall blocks 100, 200 can be stacked in a plurality of horizontal courses with or without barrier members 300 to form a wall system. As can be seen in FIG. 6, blocks 100 in each course are laid such that the side surfaces 110, 112 of each block 100 abut a side surface of each adjacent block. A barrier member 300 can be engaged with one or more blocks 100 in each course by inserting keys 312 into key slots 116. When a course has been laid, fill material, such as crushed rock or dirt, may be backfilled into core regions 152 created between barrier members 300 and blocks 100 to help stabilize the wall. A wall system comprised of wall blocks 100 and barrier members 300 may also include a course of cap blocks as the top course of the wall system to provide a finished appearance to the top of the wall.

Figure 7:
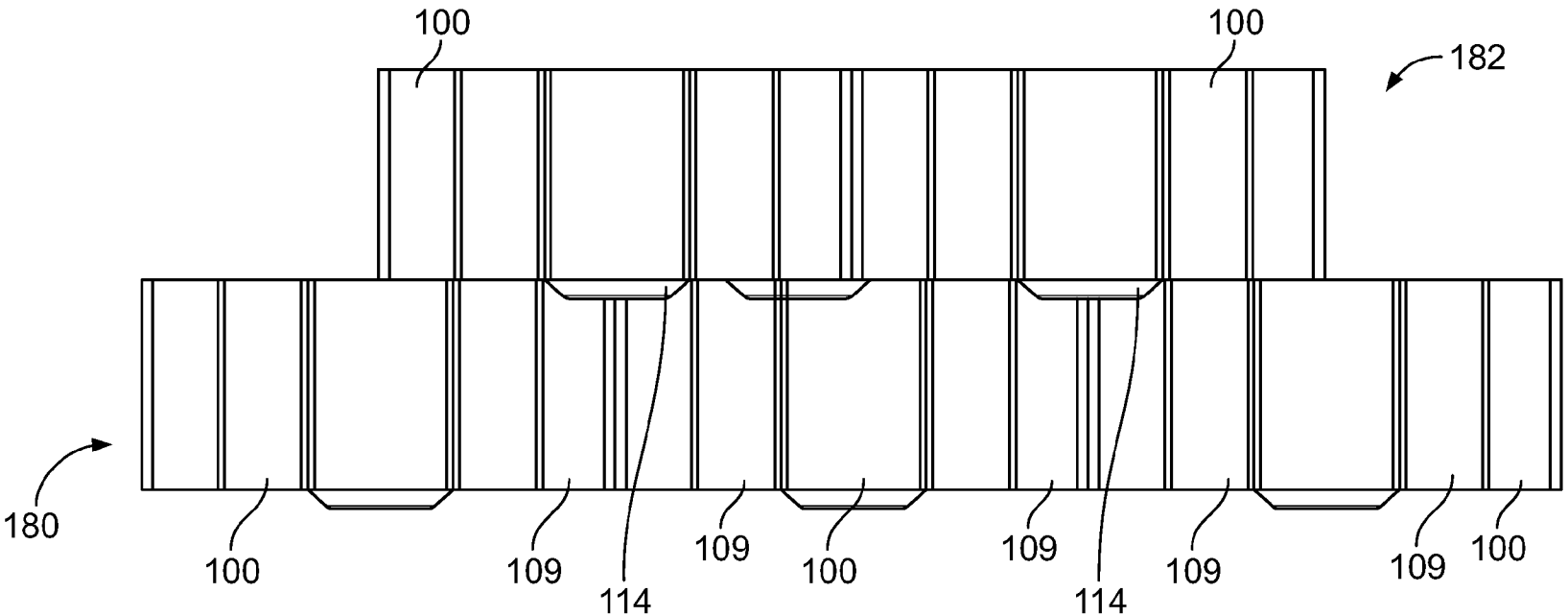
FIG. 7 is a rear view of a plurality of courses of wall blocks according to one example embodiment.
Figure 8:
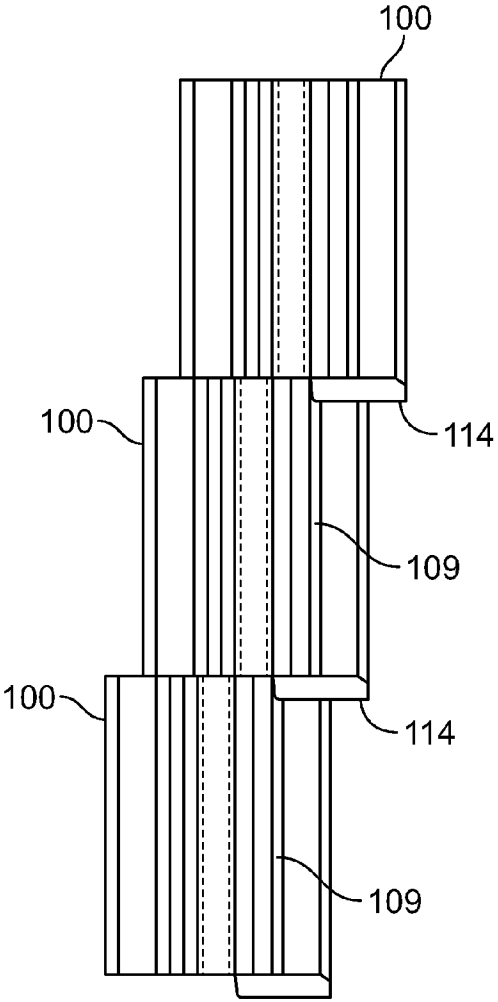
FIG. 8 is a side view of a plurality of courses of wall blocks according to one example embodiment.

As can be seen in FIG. 7, a second course 182 of blocks 100 can be placed on top of a first course 180 such that each block 100 in the second course 182 is centered above two blocks 100 in the first course 180. FIG. 7 shows blocks 100 without barrier members 300 for ease of reference. Indexing surfaces 115 of the projections 114 of the blocks 100 in the second course 182 are engaged with rearwardly facing shoulders 109 of the blocks 100 below, interlocking the blocks 100 together. Subsequent courses are placed in a like manner. Projections 114 can fit between barrier members of adjacent blocks 100. Alternatively, notches 308 of barrier members 300 can be deeper than projections 114 so that they can accommodate projections 114. As shown in FIG. 8, the interaction of projections 114 and shoulder portions 109 can also provide a setback between adjacent courses of blocks 100.

Figure 9:
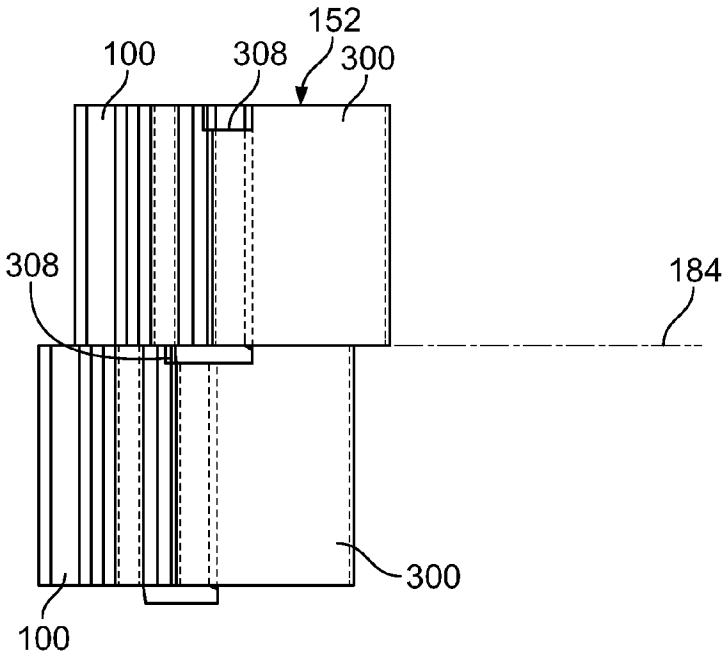
FIG. 9 is a side view of a portion of a wall system according to one example embodiment.
Figure 10:
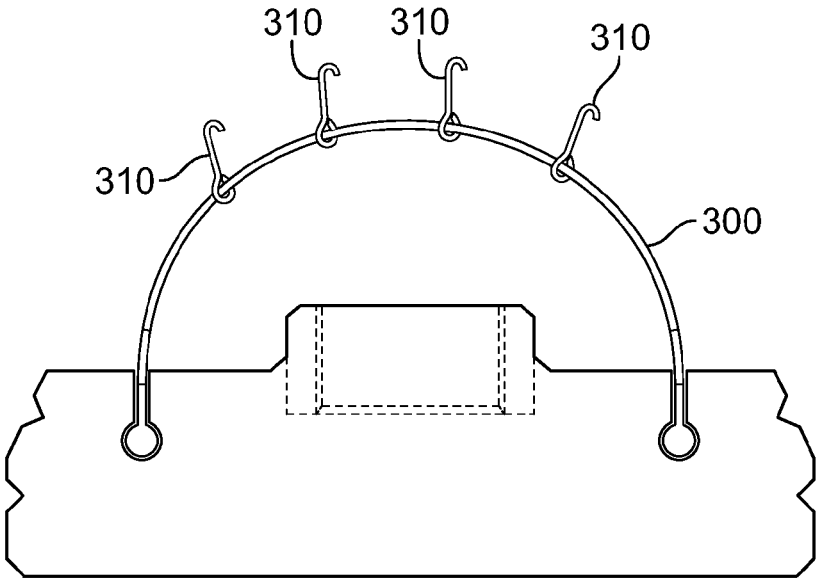
FIG. 10 is a top view of a block assembly according to one example embodiment.

Referring to FIG. 9, an earth anchor 184 can be situated between courses of blocks 100 as a part of a wall system. The blocks provided herein may be used with various types of earth anchors 184, such as such as metal grids or lattices and plastic grids or lattices such as geo-grid, which are known in the art and significantly improve the stability of a wall. An earth anchor 184 may be placed between courses of blocks 100 and extends back into the earth and other material behind the wall. Earth anchor 184 can be held in place by the weight of the fill material deposited in core regions 152 formed between barrier members 300 and blocks 100. The fill material, and projections if used, deform the earth anchor 184 to hold it firmly in place. This prevents the earth anchor 184 and wall from being easily disengaged from one another due to forces on the wall. An elongate member can also be positioned in notches of barrier member 300 to further retain earth anchor 184. Alternatively, as shown in FIG. 10, barrier members 300 can include one or more hooks 310 for forming a positive connection with an earth anchor. One of skill in the art will recognize that various other connection means can be used to positively connect barrier members 300 with earth anchors 184, such as, for example, projections.

Users can be provided with instructions on how to build walls with wall blocks and barrier members. The instructions can be provided with blocks and barrier members in the form of a kit for building a retaining wall. The instructions can be provided to users by distributors of the blocks. Instructions may be provided in many varied ways, including written such as installation manuals and advertisements, video, electronic such as materials posted on a website, verbal such as part of a training seminar, and any combination of the preceding. The instructions may include laying a first course of blocks and engaging one or more of the blocks with a barrier member to form core regions. Alternatively, the barrier members may be engaged with the block prior to installation in the wall. Fill material can then be deposited into the core regions. A second course of blocks can then be laid on the first course, such that projections on the blocks in the second course (or the barrier members) engage rearwardly facing surfaces of the blocks in the first course. Barrier members can be engaged with one or more of the blocks in the second course and fill material can be deposited into the core regions formed by the barrier members and the blocks in the second course. Excavating a trench in the ground and installing a leveling pad within the trench onto which the first course of blocks may also be part of the possible instructions. The instructions may further include use of an earth anchor. An earth anchor can be placed on the second course of blocks and extending it back from the wall, laying a third course of blocks on the second course, engaging a barrier member with one or more of the blocks in the third course and depositing fill material into the core regions formed by the barrier members and the blocks in the third course. Blocks in adjacent courses can be horizontally offset from each other by one-half of a block.

The embodiments above are intended to be illustrative only of the principles of the invention and not limiting. Additional embodiments are encompassed within the scope of the claims. Although the present invention has been described with reference to particular embodiments, those skilled in the art will recognize that changes may be made in form and detail without departing from the spirit and scope of the invention. For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed is:

1. A retaining wall block, comprising:

a top surface and opposing bottom surface, front surface and opposing rear surface, and first and second opposing side surfaces, the rear surface defining a pair of rearward facing shoulders that are generally parallel with the front surface;

a projection between the pair of rearward facing shoulders extending downwardly from the bottom surface including a forwardly facing indexing surface oriented generally parallel with the front surface of the block, wherein the indexing surface is configured to engage shoulders of blocks in a lower course of blocks; and a pair of spaced apart key slots defined in the rear surface, each key slot configured to receive a correspondingly shaped key therein and including an enlarged interlocking portion and a throat portion extending from the interlocking portion to the rear surface.

2. The block of claim 1, wherein the key slots extend generally vertically from either the top surface or the bottom surface but do not extend through the opposite surface.

3. The block of claim 1, wherein each side surface defines one or more notches.

4. The block of claim 1, wherein the rear surface includes a pair of rearwardly facing shoulders, each shoulder oriented generally parallel with the front surface of the block and configured to be engaged with an indexing surface of a projection of an identical block in a vertically adjacent course of blocks.

5. The block of claim 4, wherein the rearwardly facing shoulders are substantially parallel to the front surface.

6. The block of claim 1, wherein the rearwardly facing surface is substantially parallel to the front surface.

7. A retaining wall block, comprising:

a top surface and opposing bottom surface, front surface and opposing rear surface, and first and second opposing side surfaces;

a projection extending downwardly from the bottom surface including a forwardly facing indexing surface oriented generally parallel with the front surface of the block, wherein the indexing surface is configured to engage a rearwardly facing surface of a block in a lower course of blocks; and a pair of spaced apart key slots defined in the rear surface, each key slot configured to receive a correspondingly shaped key therein and including an enlarged interlocking portion and a throat portion extending from the interlocking portion to the rear surface, wherein the key slots extend in a generally vertical direction from the top surface to the bottom surface.

8. A block and barrier member assembly comprising:

a retaining wall block presenting a top surface and opposing bottom surface, front surface and opposing rear surface, first and second opposing side surfaces and a pair of spaced apart key slots defined in the rear surface, each key slot including an enlarged interlocking portion and a throat portion extending from the interlocking portion to the rear surface, the retaining wall block further comprising a projection extending downwardly from the bottom surface including a forwardly facing indexing surface oriented generally parallel with the front surface of the block, wherein the indexing surface is configured to engage a rearwardly facing surface of a block in a lower course of blocks; and an elongate barrier member including a body presenting an inner surface and an outer surface and a pair opposing ends, each opposing end defining a key with an enlarged interlocking portion, wherein the enlarged interlocking portion of each key is received in the enlarged interlocking portion of a separate one of the key slots so as to inhibit rearward horizontal displacement of the key within the key slot and wherein the inner surface of the barrier member and the rear surface of the block together define a core region for receiving fill material, wherein the barrier member defines a pair of notches arranged to accommodate a projection extending downwardly from an upper course of blocks.

9. The assembly of claim 8, wherein the barrier member has an arcuate shape.

10. The assembly of claim 8, wherein the barrier member comprises a flexible material.

11. The assembly of claim 8, wherein the barrier member further comprises a plurality of projections configured to engage an earth anchor.

12. A retaining wall system comprising:

a plurality of retaining wall blocks stacked in a plurality of courses, each block comprising a top surface and opposing bottom surface, front surface and opposing rear surface, first and second opposing side surfaces and a pair of spaced apart key slots defined in the rear surface, each key slot including an enlarged interlocking portion and a throat portion extending from the interlocking portion to the rear surface, each block comprising a projection extending downwardly from the bottom surface including a forwardly facing indexing surface oriented generally parallel with the front surface of the block, wherein the indexing surface is configured to engage a rearwardly facing surface of a block in a lower course of blocks; and a barrier member operably coupled with one or more of the blocks, the barrier member including a body presenting an inner surface and an outer surface and a pair of keys, the keys interlocked within the key slots of the block such that the keys cannot be horizontally displaced in a rearward direction in the slots and wherein the inner surface of the barrier member and the rear surface of one or more of the blocks define a core region for receiving fill material, wherein the barrier member defines a pair of notches arranged to accommodate a projection extending downwardly from an upper course of blocks when coupled to the one or more of the blocks in a lower course of blocks.

13. The wall system of claim 12, further comprising fill material disposed in the core region.

14. The wall system of claim 13, wherein the fill material is crushed rock.

15. The wall system of claim 12, further comprising an earth anchor held between two of the plurality of courses of blocks.

16. A method of building a wall system, comprising:

laying a first course of blocks, each block comprising a top surface and opposing bottom surface, front surface and opposing rear surface, first and second opposing side surfaces and a pair of spaced apart key slots defined in the rear surface, each key slot including an enlarged interlocking portion and a throat portion extending from the interlocking portion to the rear surface;

engaging a barrier member with one or more of the blocks in the first course, the barrier member including a body presenting an inner surface and an outer surface and a pair of opposing ends, each of the ends having a key, each key interlocked with a separate one of the key slots of the block such that the key cannot be horizontally displaced rearwardly within the key slot and wherein the barrier member defines a core region bounded by the inner surface of the barrier member and a portion of the rear surface of at least one of the blocks;

laying a second course of blocks on top of the first course such that the barrier members engaged with the blocks in the first course cannot be vertically displaced from the blocks;

engaging an indexing surface of a projection of the blocks in the second course with one or more rearwardly facing surfaces of one or more blocks in the first course, wherein the projection is at least partially received in at least one notch defined by the barrier material; and engaging a barrier member with one or more of the blocks in the second course.

17. The method of claim 16, further comprising depositing fill material within the core regions.

18. The method of claim 16, further comprising placing an earth anchor between the first course of blocks and the second course of blocks.

19. A kit for building a retaining wall comprising:

a plurality of retaining wall blocks, each block comprising a top surface and opposing bottom surface, front surface and opposing rear surface, first and second opposing side surfaces and a pair of spaced apart key slots defined in the rear surface, each key slot including an enlarged interlocking portion and a throat portion extending from the interlocking portion to the rear surface, each block further comprising a projection extending downwardly from the bottom surface including a forwardly facing indexing surface oriented generally parallel with the front surface of the block, wherein the indexing surface is configured to engage a rearwardly facing surface of a block in a lower course of blocks;

a plurality of barrier members, each barrier member including a body presenting an inner surface and an outer surface and a pair of keys, each keys slidably engagable in a vertical direction in a separate one of the key slots of one of the blocks wherein the inner surface of the barrier member and the rear surface of the block together define a core region for receiving fill material, wherein each barrier member defines a pair of notches arranged to accommodate a projection extending downwardly from an upper course of blocks when coupled to the one or more of the blocks in a lower course of blocks; and instructions for stacking the wall blocks and for engaging the keys of a barrier member in the key slots of a block.

20. The kit of claim 19, further comprising instructions for depositing fill material into the core region.

21. The kit of claim 19, further comprising instructions to interlock a projection of a block in one course of blocks with a rearwardly facing surface of a block in an adjacent course of blocks.

22. The kit of claim 19, further comprising an earth anchor and instructions for placing the earth anchor between adjacent courses of blocks and extending the earth anchor rearward from the retaining wall.

23. The kit of claim 19, wherein the instructions are provided on a tangible medium comprising an instruction sheet, an instruction booklet, a brochure, a catalog, an audio tape, or a video.

* * * * *